US007262699B2

(12) United States Patent
Marsilio et al.

(10) Patent No.: US 7,262,699 B2
(45) Date of Patent: Aug. 28, 2007

(54) SECURITY DEVICE FOR CYLINDRICAL MERCHANDISE

(75) Inventors: Ronald M. Marsilio, Lake Wylie, SC (US); Christopher J. Fawcett, Charlotte, NC (US)

(73) Assignee: Alpha Security Products, Inc., Charlotte, NC (US)

( * ) Notice: Subject to any disclaimer, the term of this patent is extended or adjusted under 35 U.S.C. 154(b) by 258 days.

(21) Appl. No.: 11/026,589

(22) Filed: Dec. 30, 2004

(65) Prior Publication Data

US 2006/0145866 A1 Jul. 6, 2006

(51) Int. Cl.
*G08B 13/14* (2006.01)
*B65D 85/57* (2006.01)

(52) U.S. Cl. ..... 340/572.1; 340/572.8; 340/568.1; 206/307.1; 206/308.1

(58) Field of Classification Search ..... 340/572.1, 340/572.8, 572.9, 568.1, 571, 693.5; 206/307, 206/307.1, 308, 308.1, 308.2
See application file for complete search history.

(56) References Cited

U.S. PATENT DOCUMENTS

| | | | | |
|---|---|---|---|---|
| 4,516,678 | A * | 5/1985 | Fotiadis et al. | 206/308.3 |
| 4,700,839 | A * | 10/1987 | Fujii | 206/308.3 |
| 6,820,741 | B2 * | 11/2004 | Ferguson et al. | 206/310 |
| 6,896,133 | B2 * | 5/2005 | Spagna | 206/308.2 |
| 6,910,427 | B2 * | 6/2005 | Woodall et al. | 105/358 |
| 7,121,405 | B2 * | 10/2006 | Ito et al. | 206/308.1 |

* cited by examiner

*Primary Examiner*—Toan N. Pham
(74) *Attorney, Agent, or Firm*—Sand & Sebolt

(57) ABSTRACT

A security device for holding cylindrical items of merchandise includes a cylindrical housing having a pivotably mounted lid moveable between open and closed positions. The lid includes an outer shell pivotally attached to the housing and an inner slide member mounted within the outer shell and rotatable between locked and unlocked positions to prevent unauthorized removal of the cylindrical item. An EAS tag is contained in the lid together with a spring biased locking finger activated by a magnetic field for movement of the slide member to an unlocked position.

21 Claims, 11 Drawing Sheets

SECURITY DEVICE FOR CYLINDRICAL MERCHANDISE

BACKGROUND OF THE INVENTION

1. Technical Field

The invention relates to anti-shoplifting devices, and more particularly to an anti-shoplifting device for cylindrical merchandise such as products contained in a cylindrical container. The invention provides a security device that holds an electronic article surveillance tag (EAS tag) trapped within a lid of the security device which holds the container. The security device contains a magnetic actuated lock which, when in locked position prevents pivotal opening of a lid preventing removal of the protected merchandise contained therein.

2. Background Information

Shoplifting from retail establishments has become an increasing problem in recent times. In response to the shoplifting problems, many different types of anti-shoplifting devices have been developed for protecting different types of merchandise. Many of these devices includes tags that are attached to the items of merchandise in a manner where they cannot be easily removed from the merchandise and which will sound an alarm when removed from the store. It is preferred that these EAS tags are hidden within the item such that a shoplifter cannot remove the tag without breaking a portion of the merchandise or the container in which they installed. Many of these security devices are used to protect recorded media such as CDs, DVDs, VHS, cassettes, etc. which are stored within rectangular parallelopiped boxes, many of which contain either a mechanical locking device unlocked by a mechanical key or a magnetically operated locking device, or a combination thereof. Some examples of the magnetically operated locking devices are shown in U.S. Pat. Nos. 6,422,387, 6,666,330, 6,676,175, and 6,755,055.

Recently, one type of merchandise which has come a target of shoplifters are cylindrical containers used for containing baby formula which is relatively expensive compared to many food products. These cans of baby formula are difficult to protect and to prevent theft since if tags are applied thereto, they are exposed and can be removed or defeated by some means by the intended shoplifter. Also, due to the shape of the container (cylindrical), it is difficult to use in existing security devices, which are generally parallelopiped-shaped without excessively increasing the storage space required for the protected container.

Therefore, the need exists for an improved security device which can be used to protect cylindrical items of merchandise, such as cans of baby formula or other types of products packaged in cylindrical containers, which provides both a mechanical lock preventing unauthorized removal of the merchandise from the security container, as well as, containing an electronic device to actuate an alarm if removed from the store without first removing the purchased container from the security device.

BRIEF SUMMARY OF THE INVENTION

The present invention provides a security device that holds a cylindrical item of merchandise in a protected outer housing without appreciably increasing the size of the item and which enables a plurality of the protected cylindrical items to be placed in a stacked relationship with respect to each other for display purposes and to conserve merchandise display space, and in which the outer housing is substantially transparent enabling a perspective purchaser to see the merchandise contained therein and read the material pertaining to the protected merchandise.

Another aspect of the invention is to provide a security device which can be mass produced relatively inexpensive of plastic components including a transparent cylindrical outer housing having a two-piece lid pivotally mounted thereon, with the lid being comprised of an outer shell and an inner slide member containing both an EAS tag and magnetic actuated fingers concealed therein to prevent unauthorized access to the protected merchandise.

A still further aspect of the invention is to provide such a security device in which the lock can be actuated only by a certain type of magnetic key which must be accurately placed on the access lid in order to actuate internal magnetic susceptible locking fingers in order to rotate the inner slide member to an unlocked position for subsequent pivotal opening of the lid permitting removal of the cylindrical merchandise from the protective housing.

These features are obtained by the improved security device of the present invention, the general nature of which may be stated as including a housing having an access opening and forming a cylindrical interior chamber for receiving and storing a cylindrical article therein; a lid mounted on the housing and moveable between open and closed positions with respect to the access opening; and a locking mechanism for locking the lid in a closed position to prevent removal of the cylindrical article from the interior chamber.

BRIEF DESCRIPTION OF THE SEVERAL VIEWS OF THE DRAWINGS

A preferred embodiment of the invention illustrated of the best mode in which Applicant contemplates applying the principles, is set forth in the following description and is shown in the drawings and is particularly and distinctly pointed out and set forth in the appended claims

Similar numbers refer to similar parts throughout the drawings.

DETAILED DESCRIPTION OF THE INVENTION

Figure 1:
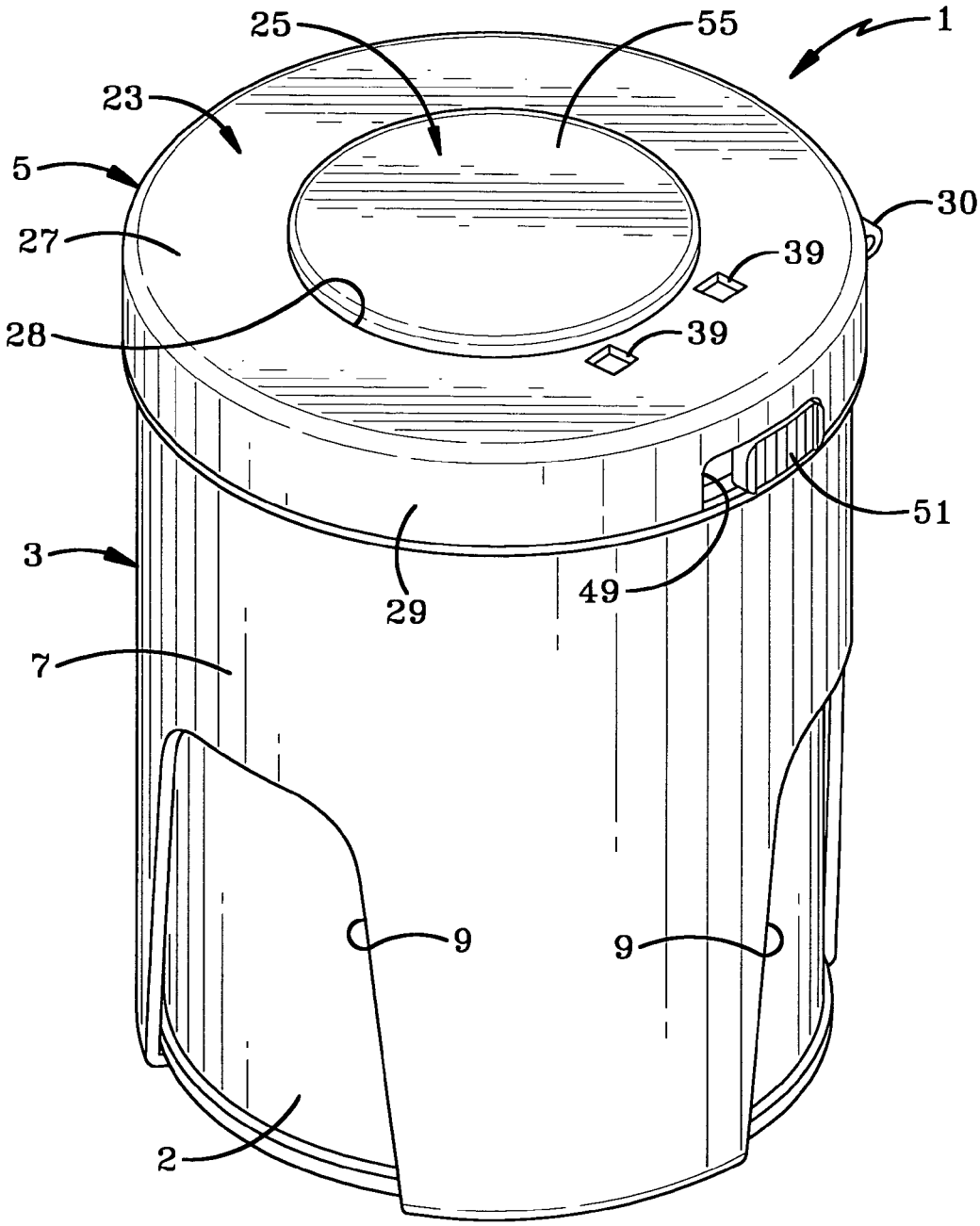
FIG. 1 is a perspective view of the improved security device in a closed locked position.

The security device of the present invention is indicated generally at 1, and is shown in an assembled locked condition in FIG. 1, holding a cylindrical item of merchandise 2. Security device 1 includes as the main components, a cylindrical housing indicated generally at 3 (FIG. 2), and a lid indicated generally at 5 (FIG. 3). Housing 3 preferably is molded as a one-piece member of a transparent plastic material such as a polycarbonate, and includes a cylindrical sidewall 7 and a generally disc-shaped end or bottom wall 8 which provide an interior chamber 4. Sidewall 7 preferably is formed with a plurality of cutouts 9 which reduces the weight and amount of material for forming the housing without sacrificing the structural and security thereof. Bottom wall 8 is generally disc-shaped and includes a raised annular central portion 11 which forms a circular concave recess 12 in the bottom wall. Preferably, housing 3 is completely transparent enabling a perspective purchaser to view the merchandise contained therein and to read any instructions printed thereon. This is important for certain types of merchandise to be secured within housing 3 such as baby formula. However, portions of the housing could be opaque or translucent without affecting the concept of the invention, so long as the important portions of the merchandise can be viewed either through the transparent walls or cutouts 9.

Figure 2:
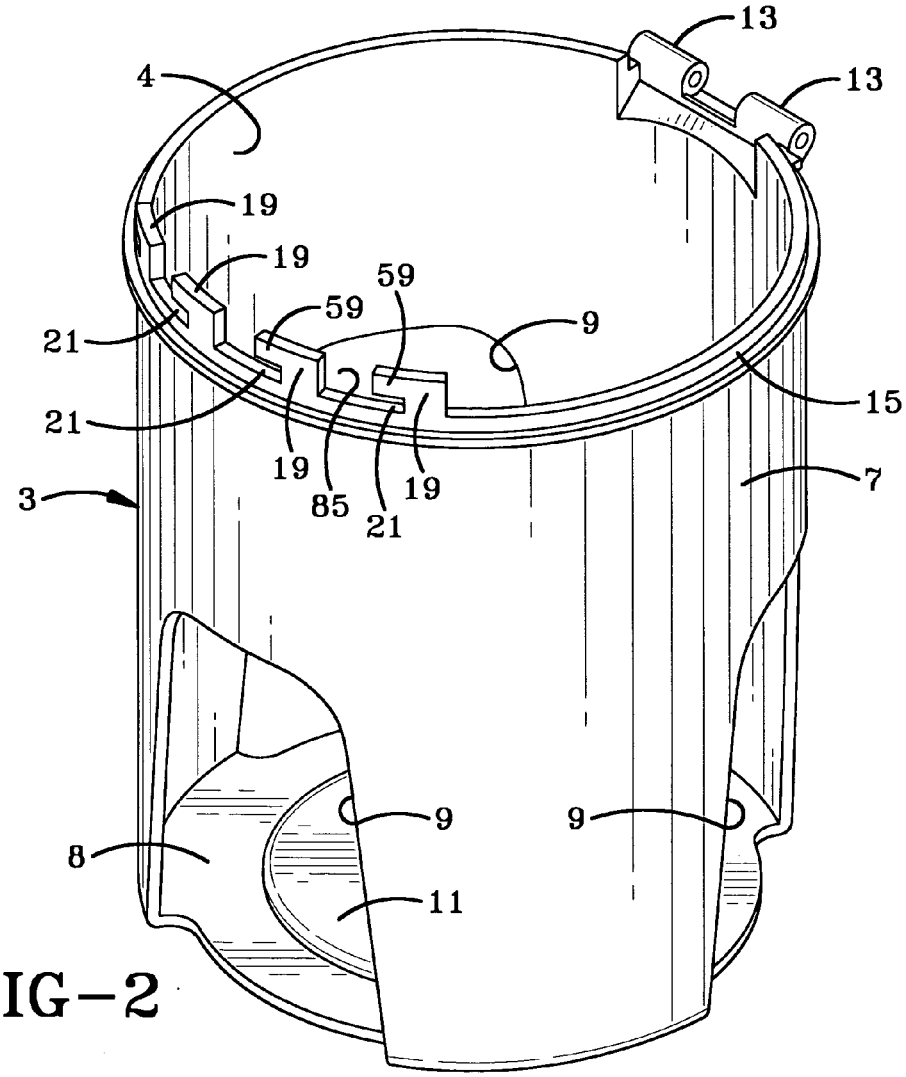
FIG. 2 is a perspective view of the outer housing of the security device of FIG. 1 with the lid removed therefrom.
Figure 3:
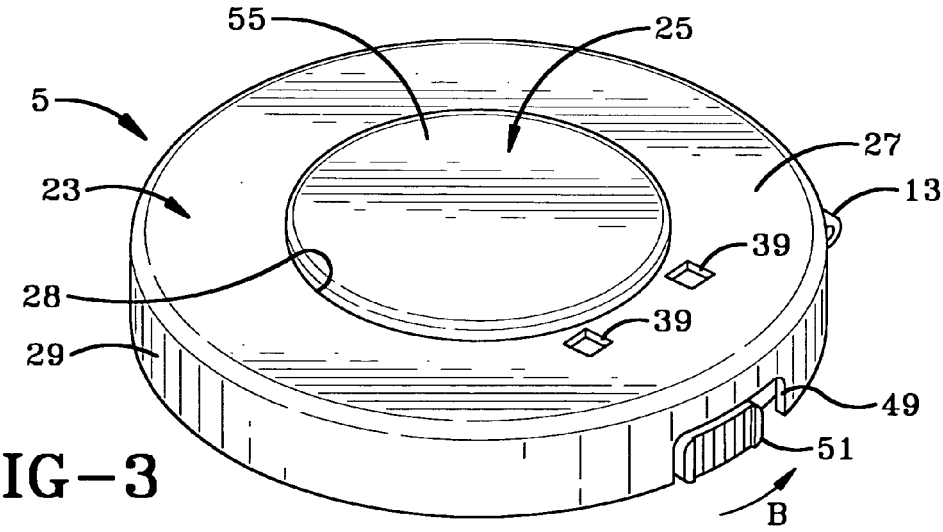
FIG. 3 is a perspective view of the lid of the security device removed from the outer housing.

As shown in FIG. 2, a pair of spaced bosses 13 are formed integrally on the rim 15 of housing 3 for receiving a pivot pin 16 (FIG. 4) therein. A plurality of locking fingers 19 are formed integrally on rim 15 generally diametrically opposite pivot bosses 13, for locking the lid in a locked position as discussed further below. Locking fingers 19 preferably have an inverted L-shaped configuration providing a locking space 21 thereon. Four locking fingers are shown in the preferred embodiment, although this number can vary without affecting the concept of the invention. This term "locking" as used herein is different than a "latched" connection which may be unlatched without the use of a key, whereas a "locked" connection requires a special key to unlock.

Figure 4:
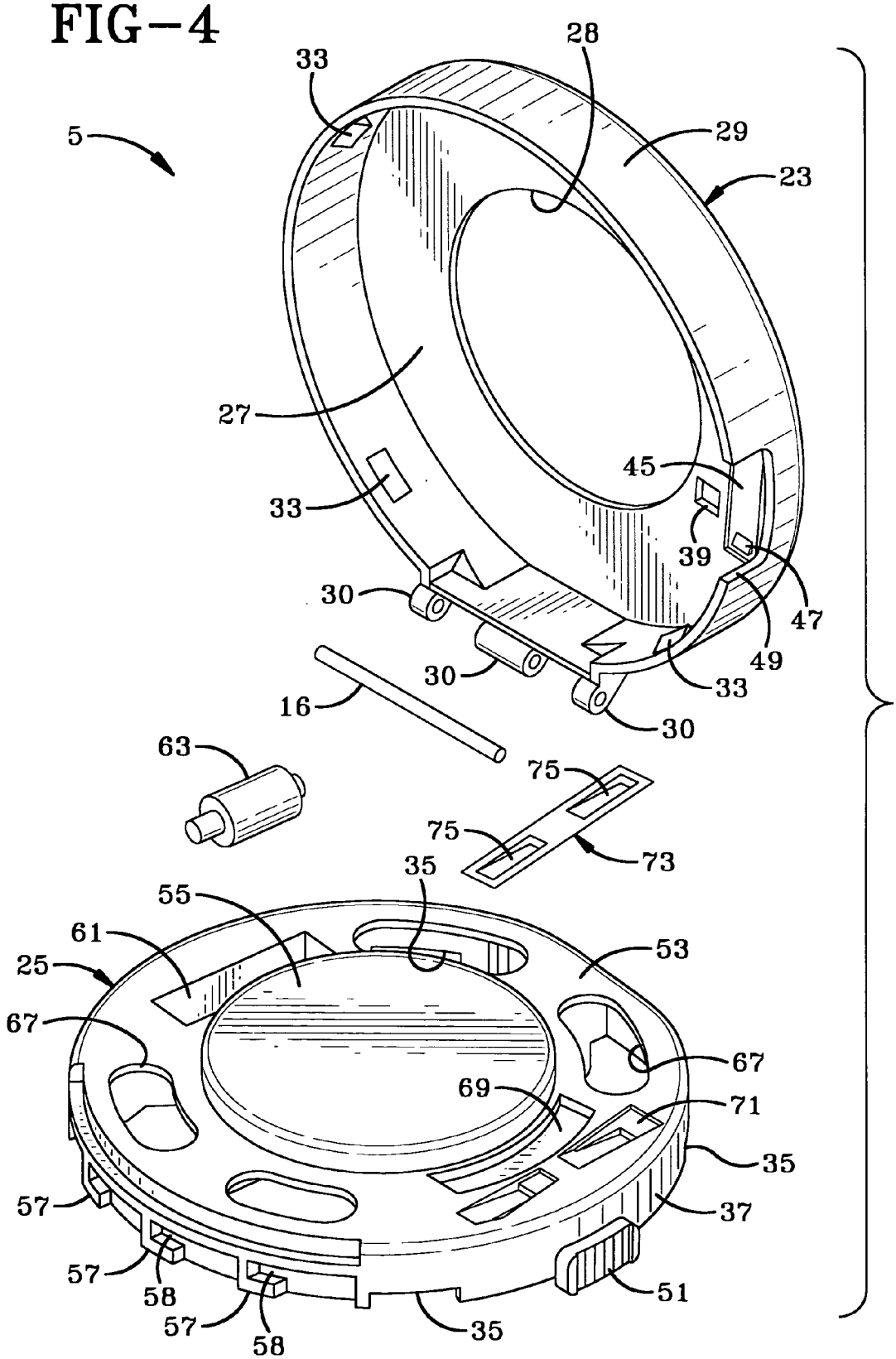
FIG. 4 is an exploded perspective view of the lid of FIG. 3.

Lid 5 is shown in a disassembled position in FIG. 4 and includes a pair of main components, an outer shell 23 and an inner slide member 25, both of which preferably are one-piece members formed of plastic and free of moveable parts. Outer shell 23 has an annular top wall 27 formed with a circular opening 28 and has a cylindrical sidewall 29. Three bosses 30 are formed on sidewall 29 for receiving bosses 13 of housing 3 therebetween and receiving pivot pin 16 for pivotally mounting outer shell 23 and the assembled lid on housing 3.

Figure 6:
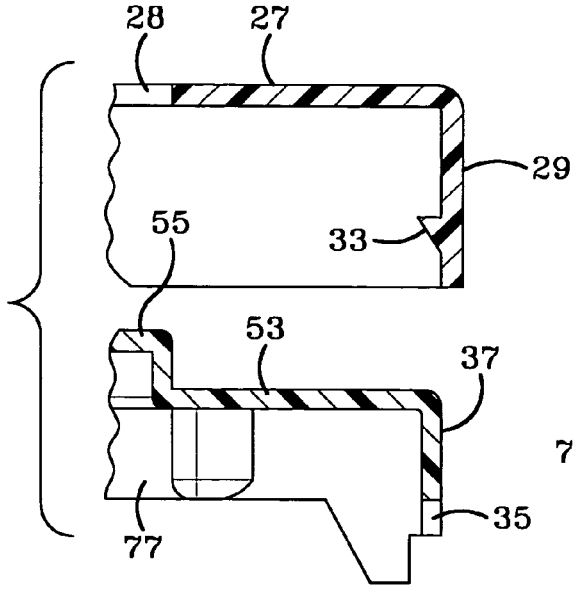
FIG. 6 is an enlarged exploded fragmentary sectional view of the outer shell and inner slide member of the lid in detached condition.
Figure 7:
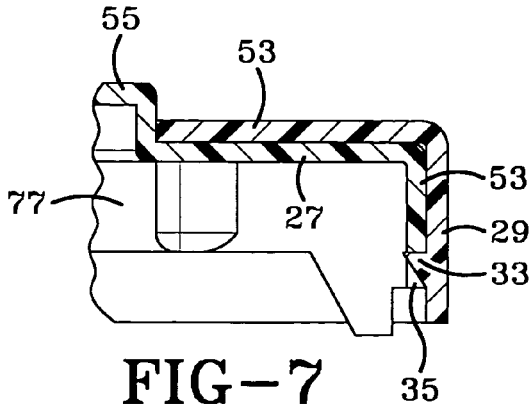
FIG. 7 is an enlarged fragmentary sectional view showing the snap-fit mounting of the lid's outer shell to the inner slide member.
Figure 8:
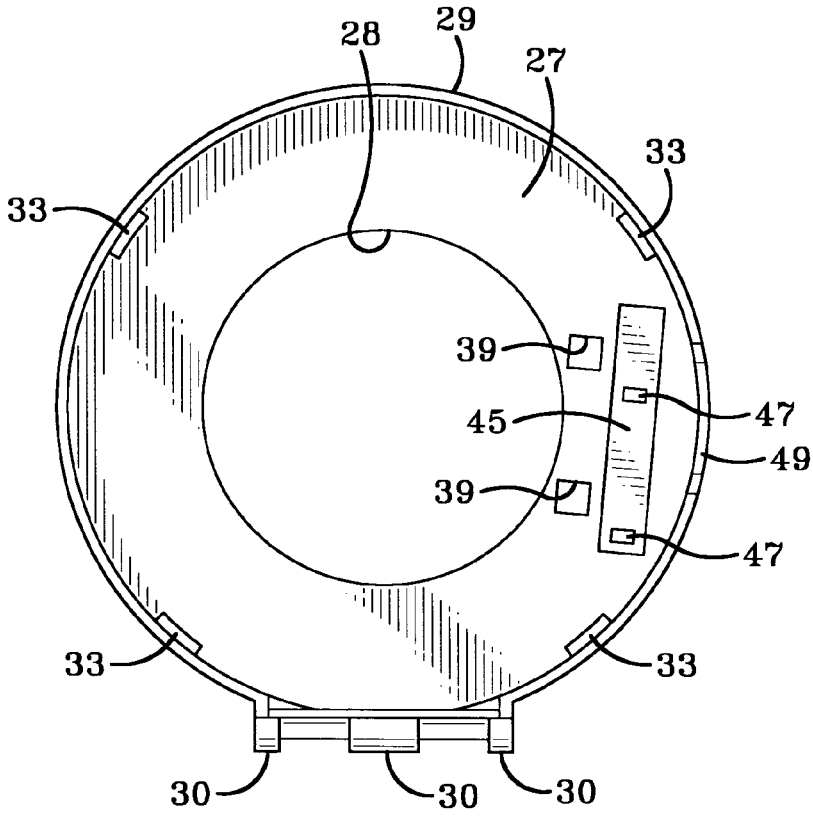
FIG. 8 is a bottom plan view of the outer shell of the lid with the inner slide member removed therefrom.

A plurality of projections 33 are formed on and spaced about the inside surface of sidewall 29 for snap-fit engagement in arcuate cutouts or notches 35 formed in a cylindrical sidewall 37 of slide member 25 to secure slide member 25 within outer shell 23, as shown particularly in FIGS. 6 and 7, and providing for limited arcuate movement therebetween. Outer shell 23 (FIGS. 4 and 8) further includes a pair of rectangular-shaped holes 39 for receiving locating pins 41 of a magnetic key 43 (FIG. 11) for unlocking the security device as described further below. A shallow rectangular-shaped channel 45 is formed in the inner surface of outer shell top wall 27 and contains two small projections 47 (FIG. 8), the purpose of which are discussed further below. Sidewall 29 is formed with an arcuate-shaped cutout 49 for receiving an actuation button 51 therein. Button 51 is formed on and extends outwardly from sidewall 37 of slide member 25.

Figure 10:
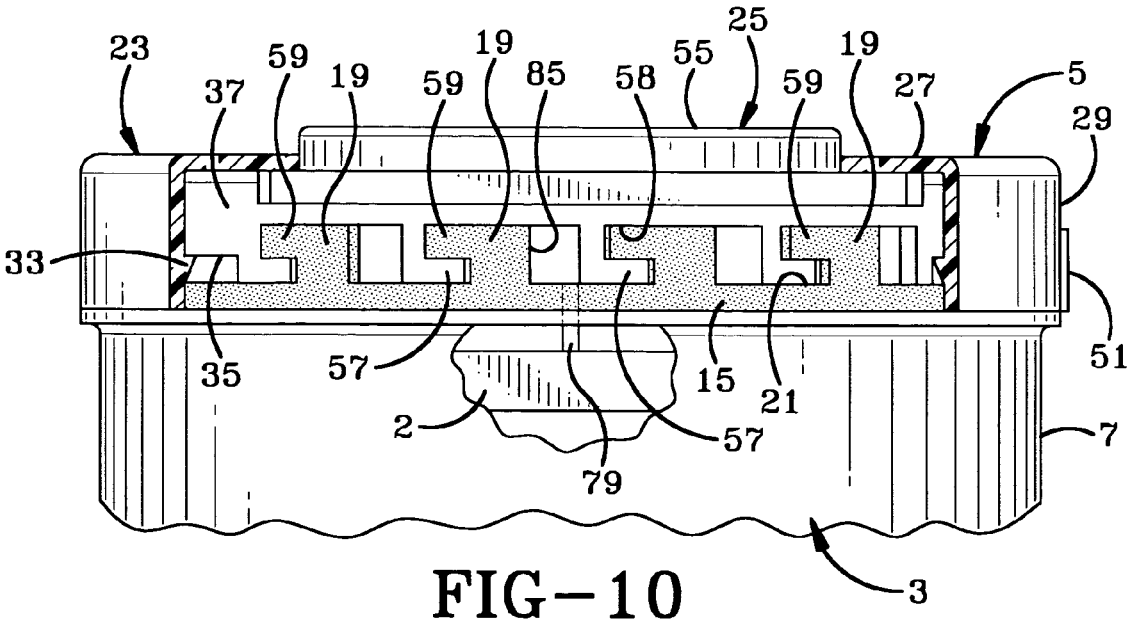
FIG. 10 is a fragmentary view, portions of which are broken away and in section, showing the cooperating locking teeth of the lid and housing in the lock position.

Slide member 25 (FIGS. 4 and 5) includes a disc-shaped top wall 53 and a raised annular central wall portion 55. Slide member 25 further includes a plurality of L-shaped locking fingers 57 which are formed in sidewall 37, and which form a plurality of locking spaces 58 in which are received complementary-shaped legs 59 of locking fingers 19 formed on housing 3 (FIG. 10). Again, four locking fingers 57 are formed in sidewall 37 and correspond with and align with locking fingers 19 of housing 3.

A cavity or recess 61 is formed in top wall 53 and has an electronic security device 63 secured therein by an adhesive or other type of attachment means. Electronic device 63 can be of various configurations and is referred to broadly in the security industry as an EAS tag, and can be magnetically or radio wave-activated in order to sound an alarm upon passing through a gate, usually located at the exit of a store, unless deactivated at the time of purchase. A plurality of arcuate-shaped cutouts 67 may be formed in top wall 53 to reduce the weight of slide member 25 without affect the security and rigidity thereof. An arcuate-shaped recess 69 is formed in top wall 53 adjacent a rectangular-shaped recess 71 in which is received a spring locking member 73.

Figure 5:
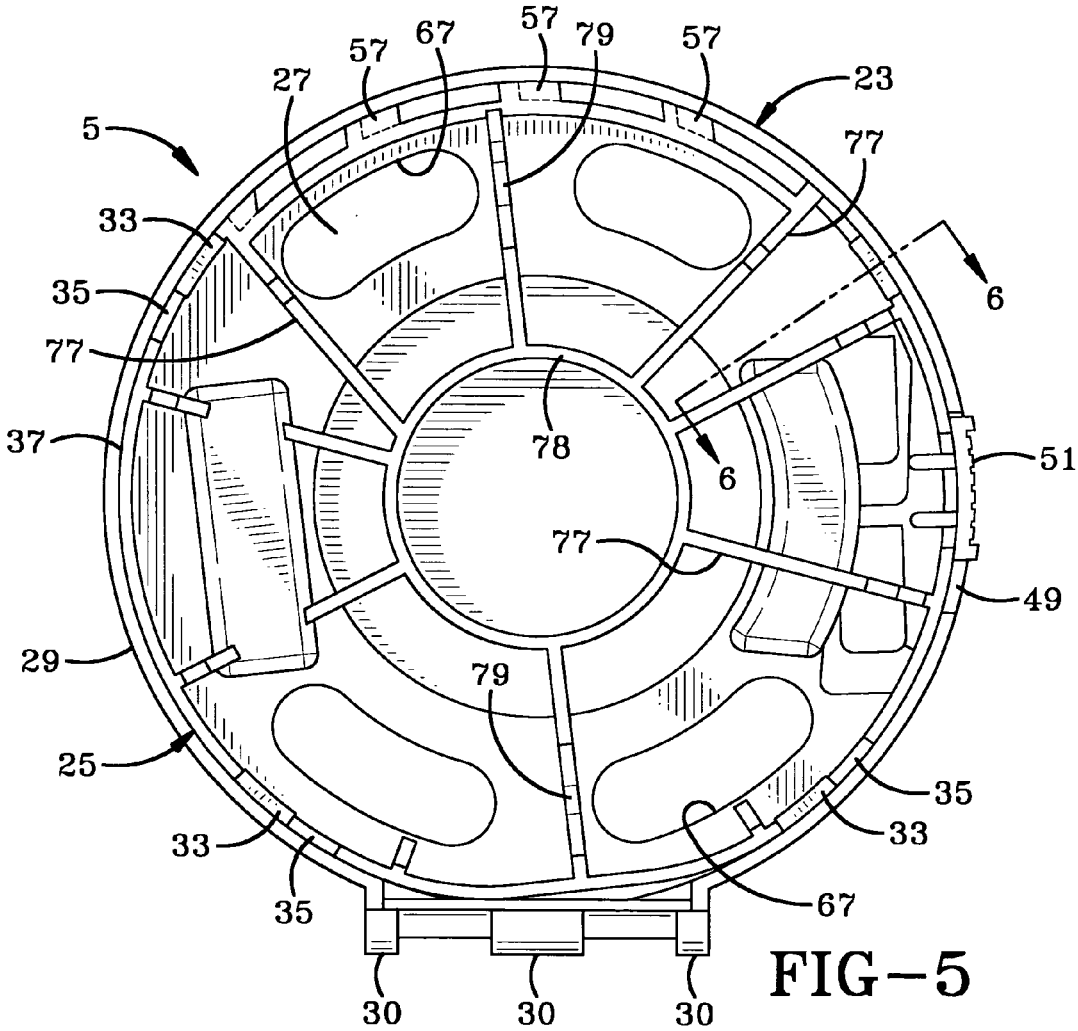
FIG. 5 is a bottom plan view of the lid.

Locking member 73 (FIG. 4) preferably is formed of metal and includes a pair of spring-biased locking fingers 75 extending outwardly therefrom, which secure slide member 25 in a locked position within outer shell 23 as discussed further below. As shown in FIG. 5, slide member 25 may include a plurality of radially extending reinforcing ribs 77 which extend between a circular reinforcing rib 78 and outer cylindrical wall 37. A pair of diametrically opposed merchandise retention tabs or projections 79 preferably are formed on and project outwardly from one of the radial reinforcing ribs 77 for engagement with the top of a cylindrical merchandise 2 to prevent it from movement when contained within housing 3.

Figure 18:
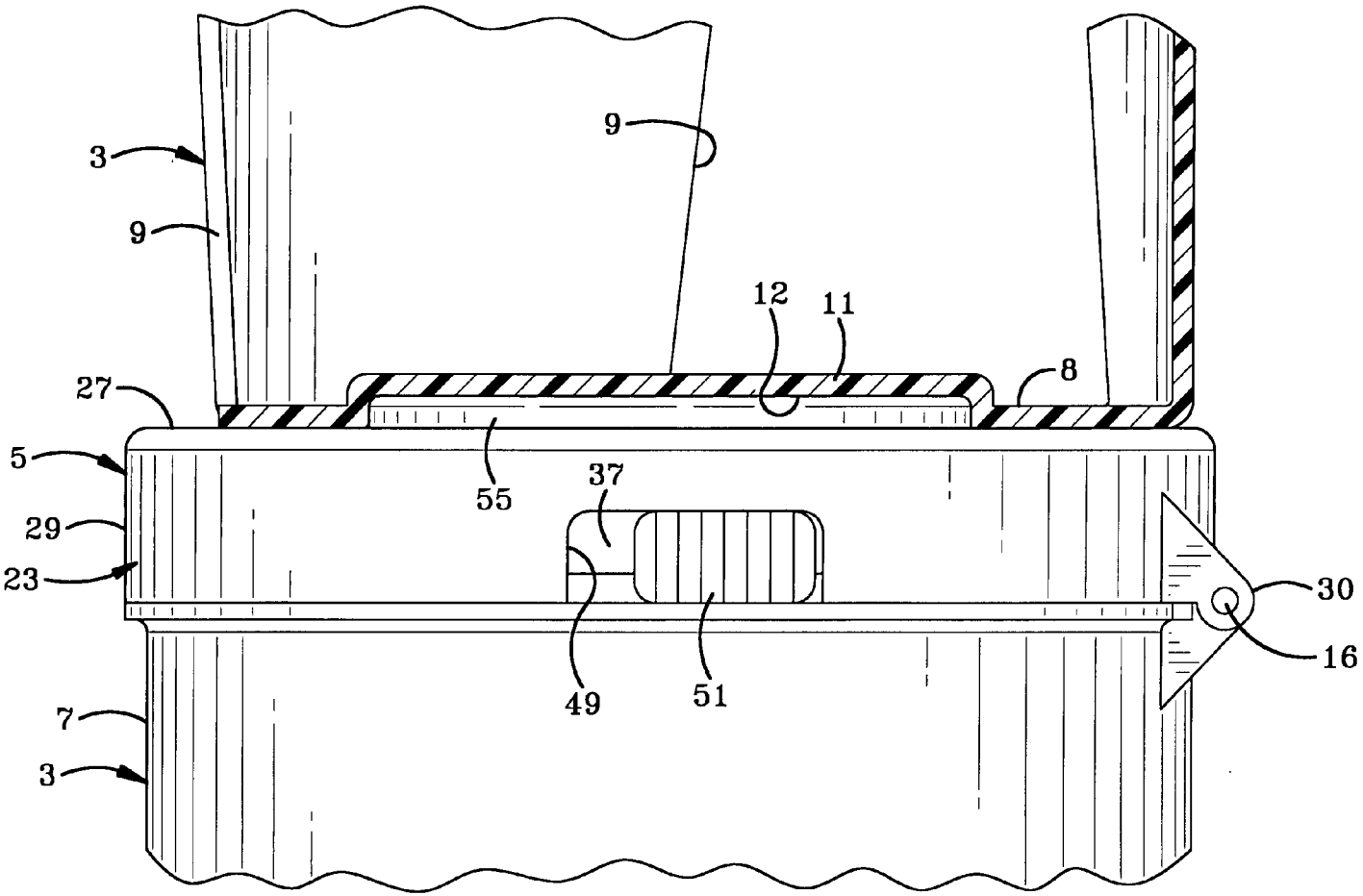
FIG. 18 is a fragmentary sectional view showing the stackability of a pair of the security devices.

In accordance with one of the features of the invention, when inner slide member 25 is snap-fitted within outer shell 23, circular central wall 55 will project through circular opening 28 of shell 23 and extend slightly upwardly therefrom as shown in FIG. 1. Wall 55 is complementary to the diameter of recess 12 formed by raised central portion 11 in bottom wall 8 of housing 3. As shown in FIG. 18, this provides for a nesting stacking relationship between adjacent security devices 1. Raised central wall portion 55 extends into recess 12 enabling a plurality of security devices 1 containing merchandise 2, to be stacked vertically one upon the other by providing some rigidity to the stacked security devices in a display environment.

Figure 12:
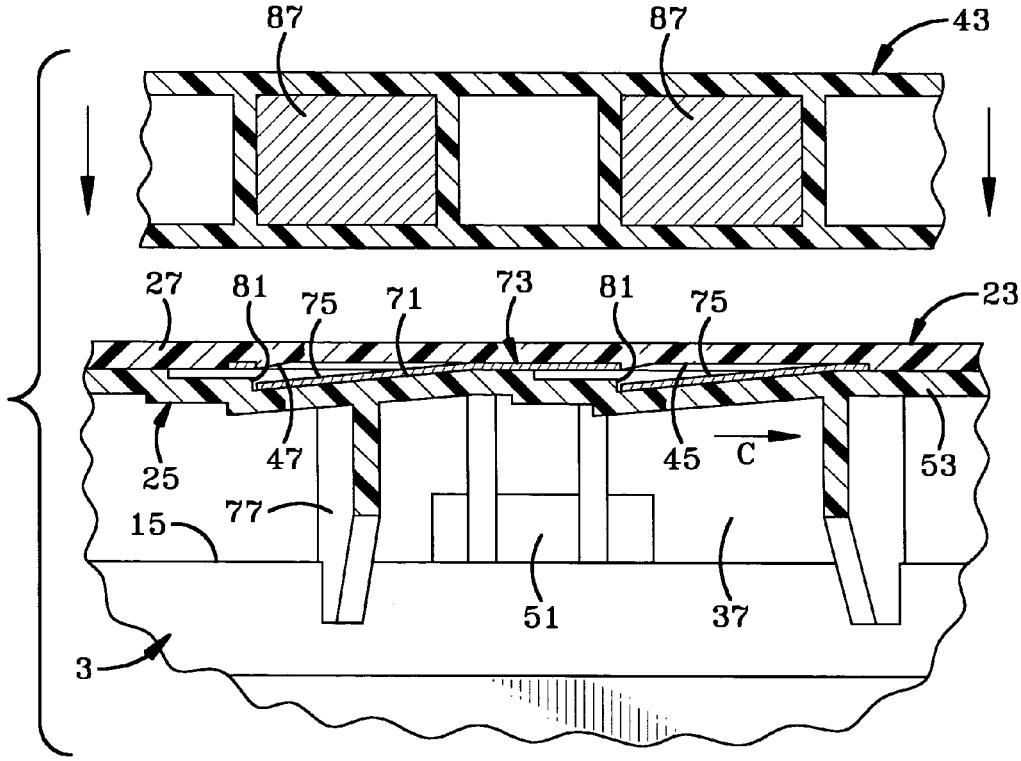
FIG. 12 is an enlarged fragmentary sectional view showing the magnetic key moving toward unlocking engagement with the locking mechanism contained in the lid of the security device.

Locking member 73 is located within channel 45 of outer shell 23 when slide member 25 is snap-fittedly engaged within outer shell 23. Locking fingers 75 extend into and along the rectangular-shaped recess 71 formed in slide member 25 as shown in FIG. 12. Locking member 73 need not be physically attached to either of the lid components, but is trapped therebetween at the desired position and is prevented from moving by its location within recess 71 and by projections 47 formed on the inner surface of lid top wall 27. This reduces manufacturing costs. The free ends of locking fingers 75 which are biased in an outward locking position, engage notches or stepped end walls 81 formed in rectangular channels 71 to prevent rotation of slide member 25 with respect to outer shell 23 toward an unlocking direction until released by key 43. Thus, when lid 5 is in the assembled position, both EAS tag 63 and locking member 73 are trapped and secured between the two components of the lid preventing access thereto by an unauthorized personnel, thereby avoiding any tampering and disabling of the security system. Also, when in the assembled position, the engagement of locking projections 33 within arcuate cutouts 35 (FIGS. 6 and 7) enables a very limited rotational movement of inner slide member 25 with respect to outer shell 23, yet retains the two components in an assembled position. Outer shell 23 can only move in a pivotal direction due to its pivotal attachment to housing 3 by pivot pin 16. The amount of arcuate or rotational movement of slide member 25 with respect to outer shell 23 is just enough to move locking fingers 19 and 57 from their locked position of FIG. 10 to the unlocked position of FIG. 15. It is easily seen in FIG. 10 that when in the locked position, lid 5 cannot pivot upwardly until the fingers are disengaged as shown in FIG. 15, wherein the lid can be moved in a pivotal direction as shown by Arrow A to an open position as shown in FIG. 9 permitting the insertion and removal of cylindrical merchandise 2 from interior chamber 4 of housing 3.

The operation of security device 1 is relatively simple and is as follows. When the lid is in the open unlocked position as shown in FIG. 9, cylindrical merchandise 2 can be inserted therein where it rests upon bottom wall 8. Lid 5 is then pivoted to a closed position, in which position fingers 57 will pass between open spaces 85 formed between adjacent fingers 19 of housing 3 as shown in FIG. 15. When lid 5 is in the closed but unlocked position as shown in FIG. 10, the user will merely move button 51 in the direction of Arrow B (FIG. 3) which will rotate slide member 25 a sufficient amount whereby the locking fingers 19 and 57 will mate in a locking position as shown in FIG. 10 preventing the pivotal movement of lid 5 toward an open position. The locking teeth are automatically secured in the locked position of FIG. 10 by spring biased locking fingers 75 moving from the unlocked position of FIG. 14 to the locked position of FIG. 12 where the free ends thereof are engaged with stepped end walls 81 preventing any rotational movement of inner slide member 25 in the unlocking direction of Arrow C (FIG. 12). Retention tabs 79 will engage the top of merchandise 2 as shown in FIG. 10 to maintain it in a firm position within interior chamber 4 avoiding rattling and unwanted movement of the merchandise therein.

Figure 9:
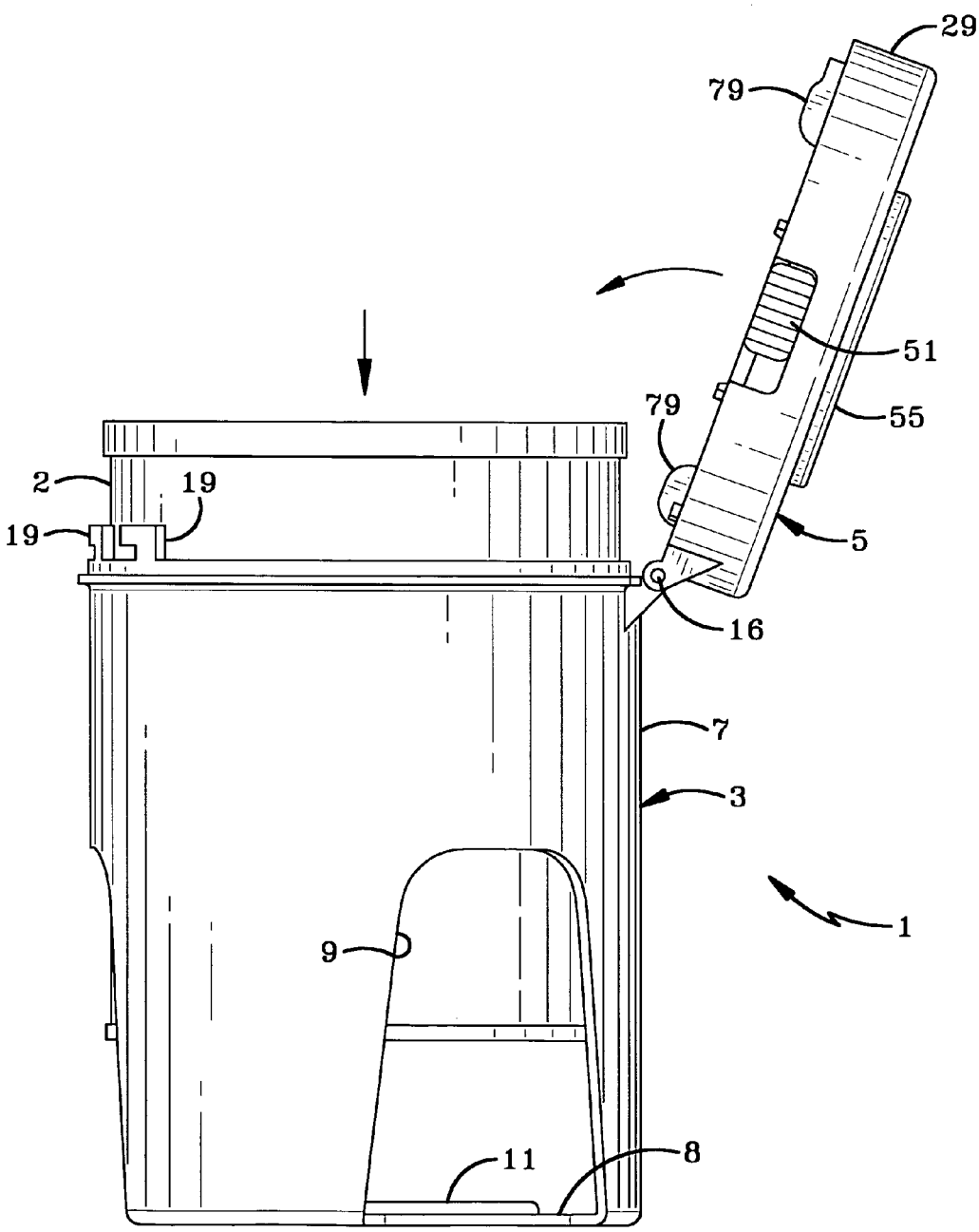
FIG. 9 is side elevational view showing the lid in an open position and a cylindrical merchandise being inserted into the security device.
Figure 11:
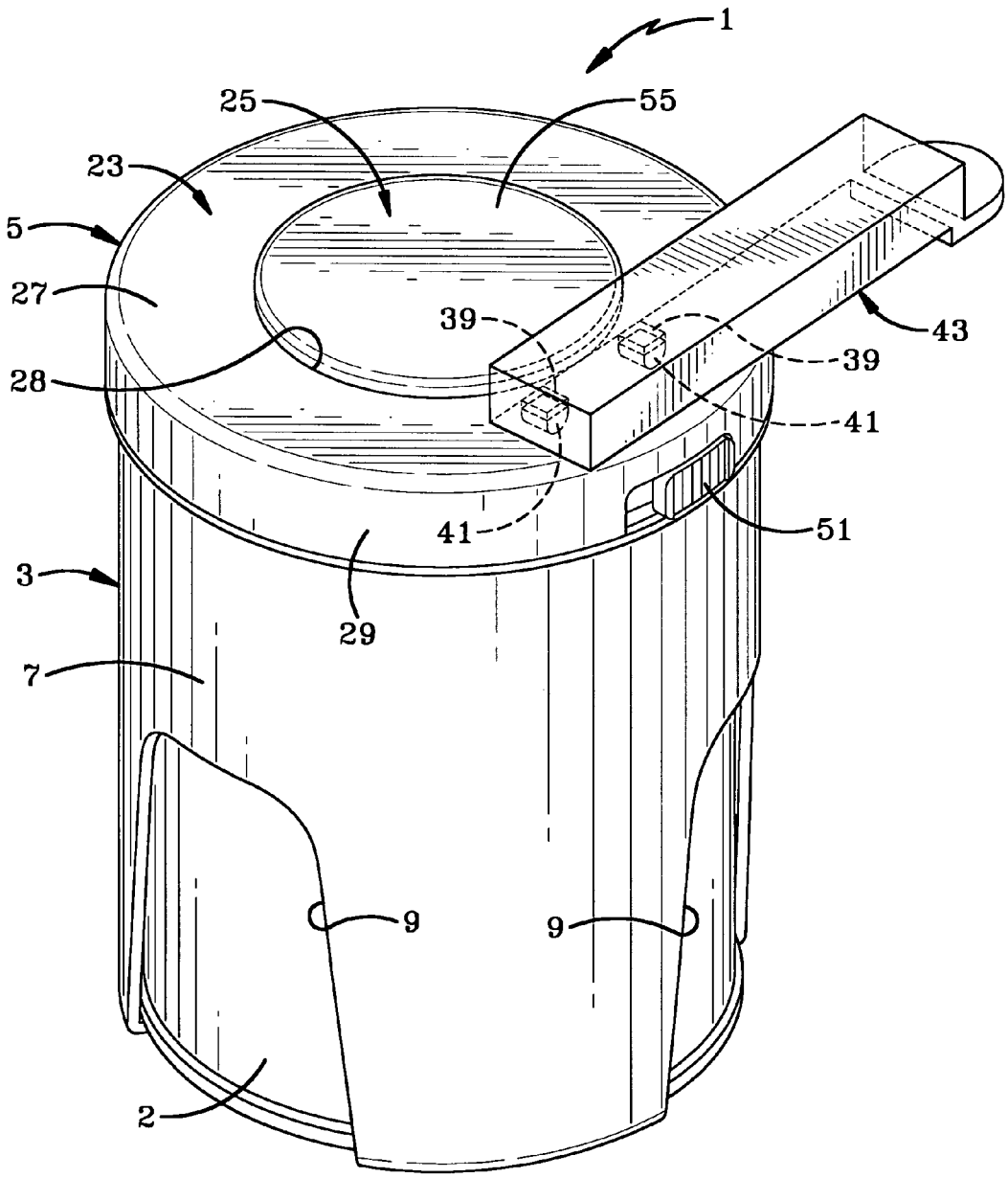
FIG. 11 is a perspective view showing the security device in locked position with a magnetic key engaged therewith for unlocking the closure lid.

To unlock lid 5 enabling it to move to the open position as shown in FIG. 9, which is usually performed at the checkout counter, a magnetic key 43 is utilized. Key 43 preferably contains a pair of magnets 87. Magnets 87 are at a specific location within the interior of magnetic key 43 and must be accurately positioned with respect to locking fingers 75 in order to actuate the same. This accurate unlocking alignment is accomplished by providing magnetic key 43 with the pair of locating pins 41 which are placed in holes 39 formed in top wall 27 of outer shell 23 (FIG. 11). If the magnetic key 43 is not properly positioned so that magnets 87 are misaligned with locking finger 75, the desired unlocking action cannot occur. Thus, someone using a single magnet or a pair of magnets not accurately placed will not be able to unlawfully open and unlock security device 1.

Figure 13:
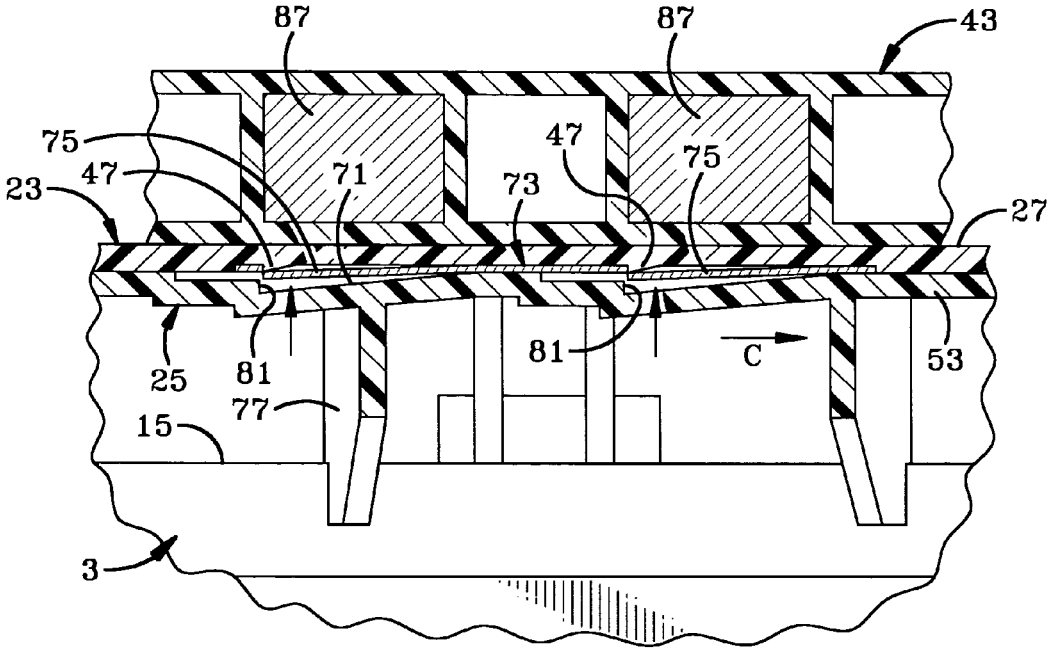
FIG. 13 is a view similar to FIG. 12 showing the magnetic key unlocking the locking fingers from the slide member of the lid.
Figure 14:
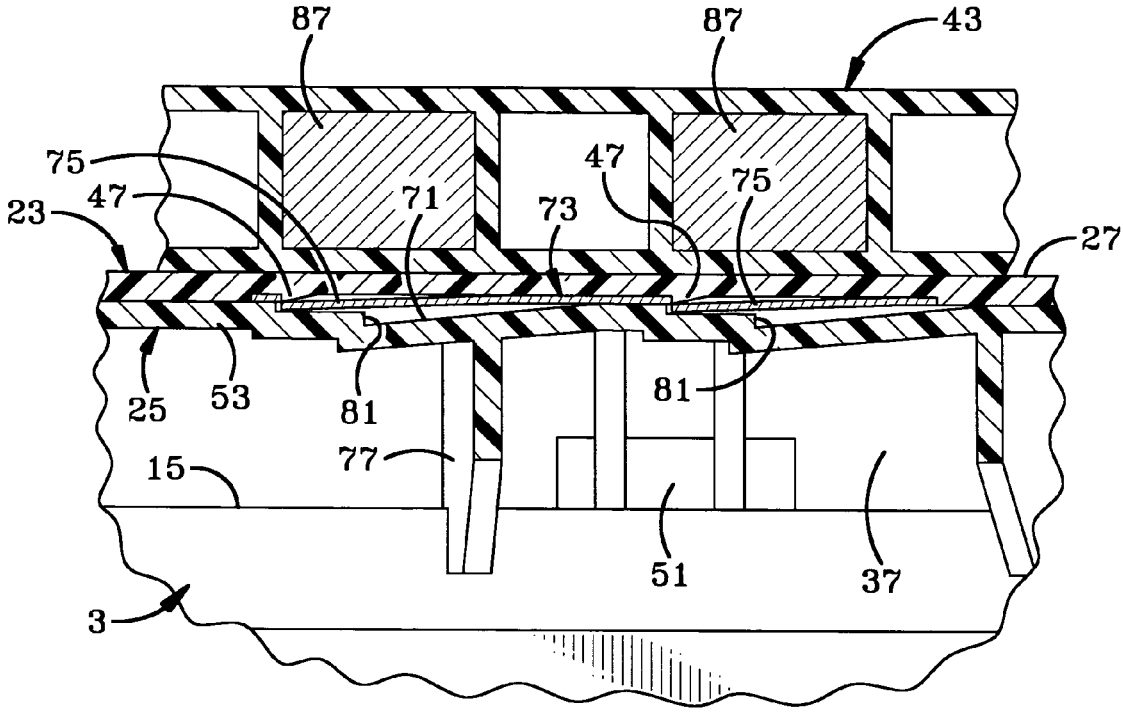
FIG. 14 is a sectional view similar to FIGS. 12 and 13 showing the slide member rotated to the unlocked position.
Figure 15:
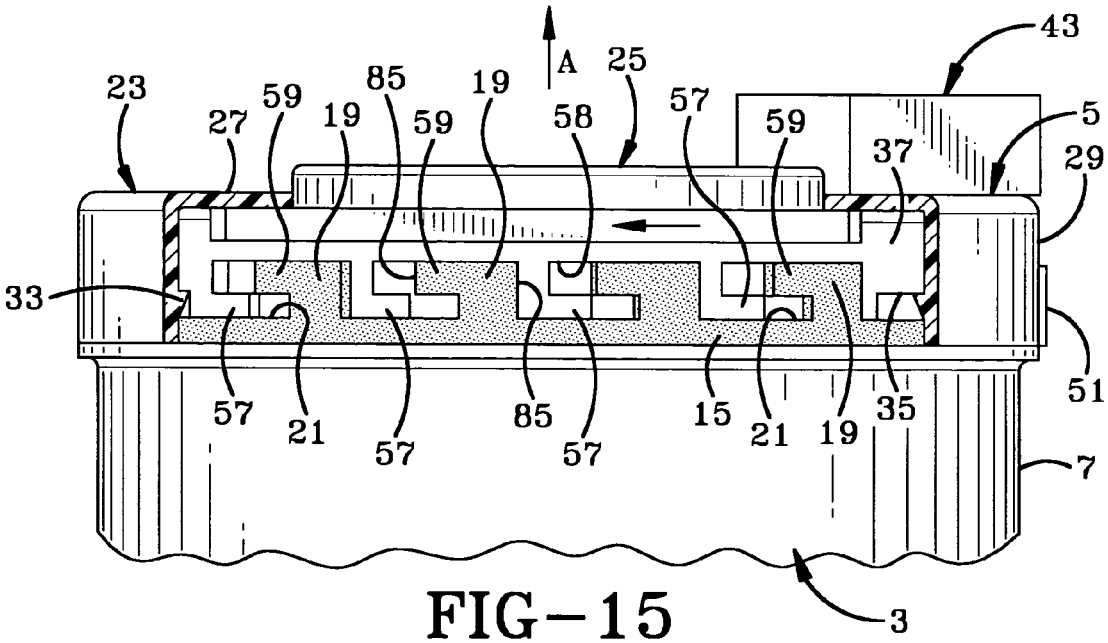
FIG. 15 is a view similar to FIG. 10 showing the locking fingers of the lid and housing in the unlocked position prior to pivotally moving the lid to an open position.

As shown in FIG. 13, proper placement of magnetic key 43 and magnets 87 will move locking finger 75 upwardly to disengage the free ends thereof with stepped walls 81 enabling inner slide member 25 to be rotated in the direction of Arrow C by movement of button 51 to the unlocked position of FIG. 14, in which position the teeth will be aligned as shown in FIG. 15 enabling lid 5 to be pivoted to the unlocked position of FIG. 9 for removal of cylindrical merchandise 2 therefrom. Security container 1 then can be easily reloaded with another cylindrical merchandise 2 and the lid moved to the closed position and upon the slight rotational movement of button 51 will permit the free ends of locking fingers 75 to automatically move downwardly to the locked position of FIG. 12 where they are engaged with stepped walls 81. This can be performed in a matter of seconds without any skill on the personnel placing merchandise 2 therein. The secured devices containing merchandise 2 can then be restocked in the nesting relationship as shown in FIG. 18 provided by central wall portion 55 and recessed bottom wall 12.

Figure 16:
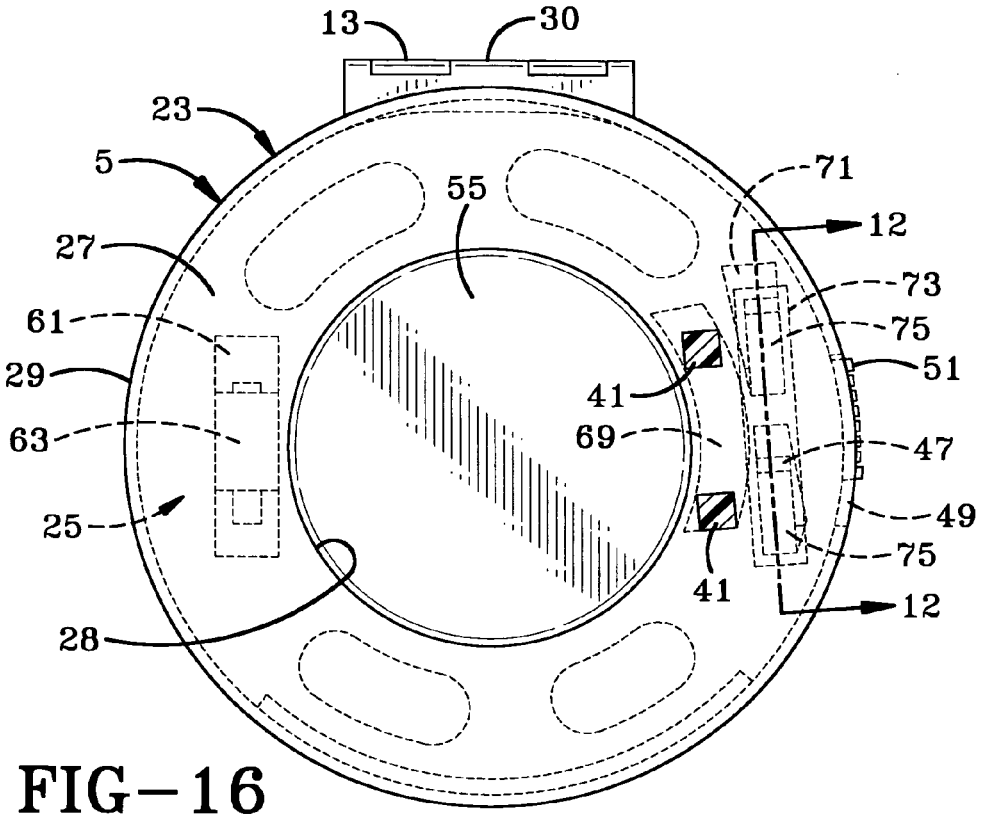
FIG. 16 is a top plan view of the lid with portions of the magnetic key in section in the locked position.
Figure 17:
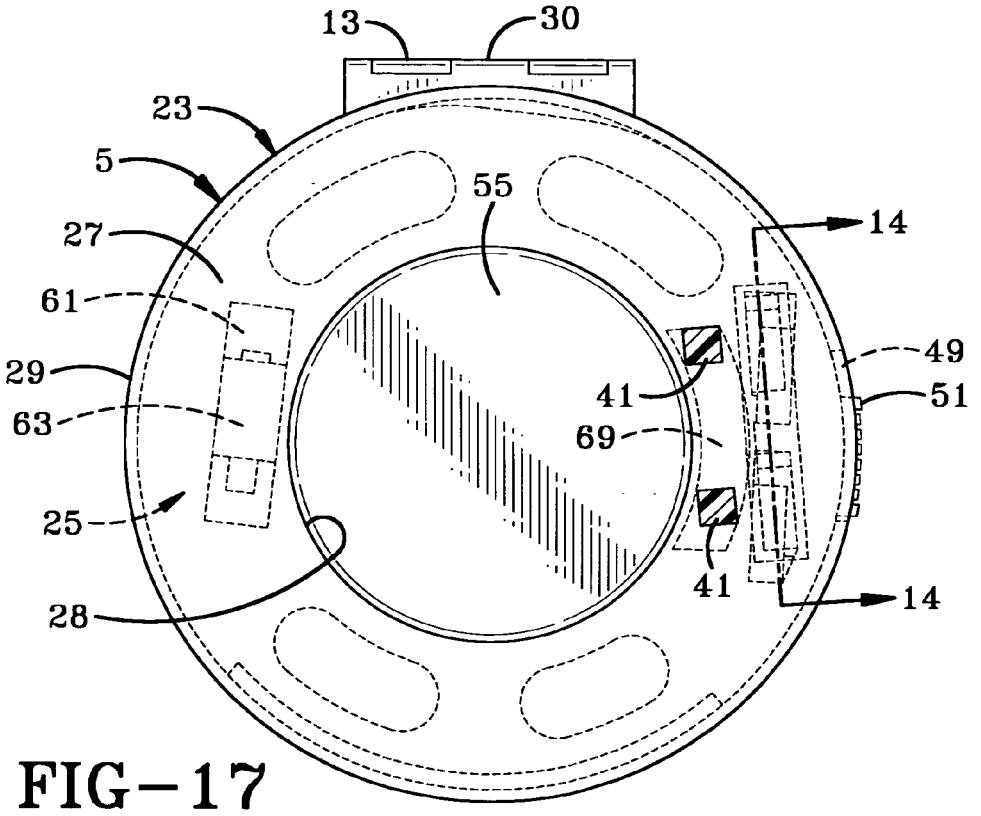
FIG. 17 is a view similar to FIG. 16 with the locking fingers in an unlock position.

As shown in FIGS. 16 and 17, locating pins 41 of key 43 when extending through rectangular-shaped holes 39 are received in arcuate-shaped recess 69 formed in slide member 25 which provide stops to limit the rotational movement of inner slide member 25 with respect to outer shell 23. Thus, as can be seen in FIGS. 16 and 17, locating pins 41 will engage the ends of recess 79 at the locked and unlocked positions to prevent further rotation of inner slide member 25 beyond these two positions.

Thus, security device 1 provides a relatively simple and inexpensive container for receiving cylindrical merchandise enabling the merchandise to be viewed through the transparent outer housing, and in which the lid conceals and traps an electronic EAS security tag as well as the magnetically actuated locking fingers.

It is understood that the magnetic locking fingers could be replaced with other types of mechanical-actuated locking paws or fingers operated by a mechanical locking key as used in various prior art media security devices, without affecting the overall concept of the invention. However, the particular magnetic sensitive spring locking member 73 and its relatively small size provides an inexpensive yet secure locking mechanism for device 1.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device for holding a cylindrical article, said device comprising:

a cylindrical housing having an access opening and forming an interior chamber for receiving and storing the cylindrical article therein;

a lid mounted on the housing and moveable between open and closed positions with the access opening, said lid including an outer shell pivotally attached to the housing and an inner slide member;

a locking mechanism for locking the lid in a closed position to prevent removal of the cylindrical article from the interior chamber; and said slide member containing a first portion of the locking mechanism which cooperates with a second portion of the locking mechanism carried by the housing for locking the lid in the closed position.

2. The device defined in claim 1 including an EAS device carried by the lid.

3. The device defined in claim 1 wherein the locking mechanism is magnetically operated.

4. The device defined in claim 1 wherein the slide member is slidably rotatable within the outer shell to move between locked and unlocked positions with the outer housing.

5. The device defined in claim 1 wherein an EAS tag is placed in a recess formed in the slide member.

6. The device defined in claim 1 wherein the slide member includes a raised central area which extends through an opening formed in the outer shell.

7. The device defined in claim 6 wherein the outer housing includes a bottom wall having a recessed central portion; and in which the raised central area of the slide member of one security device seats in said recessed central portion of another security device to provide a nesting stacking relationship therebetween.

8. The device defined in claim 1 wherein the locking mechanism includes at least one locking finger formed on the slide member which engages at least one locking finger carried by the housing when the lid is in the closed position and the slide member moved to the locked position.

9. The device defined in claim 1 wherein the locking mechanism includes a plurality of upstanding inverted L-shaped locking fingers formed on the housing slidably engageable with complementary shaped L-shaped fingers found on the slide member to secure the lid in the locked position by preventing pivotal movement of the lid.

10. The device defined in claim 1 wherein the locking mechanism includes a locking finger moveable by a magnetic field; and in which the locking finger is trapped between the outer shell and slide member and biased toward a locked position preventing rotation of the slide member within the outer shell from the locked to the unlocked position.

11. The device defined in claim 10 wherein a pair of holes are formed in the outer shell of the lid for receiving positioning tabs of a magnetic key to align at least one magnet in said key adjacent the locking finger to move the finger from the locked position with the slide member.

12. The device defined in claim 11 wherein the positioning holes in the outer shell of the lid are in alignment with a groove formed in the slide member.

13. The device defined in claim 10 wherein the locking finger has a free end which extends into a recess formed in the slide member and engages a wall thereof to prevent rotation of the slide member with respect to the outer shell when in the locked position.

14. The device defined in claim 13 wherein the locking finger is a metal strip formed with a pair of spring biased locking fingers extending therefrom.

15. The device defined in claim 14 in combination with a magnetic key containing a pair of magnets and having a positioning tab engageable with a positioning opening formed in the lid for aligning each of the magnets with respective ones of the locking fingers to move said fingers to an unlocked position.

16. The device defined in claim 1 wherein the slide member is snap-fitted into engagement within the outer shell of the lid.

17. The device defined in claim 1 wherein the outer shell and slide member have cylindrical sidewalls; and in which an actuation button carried by the sidewall of the slide member projects through a cutout formed in the sidewall of the outer shell for moving the slide member between locked and unlocked positions.

18. The device defined in claim 1 wherein the housing is formed of a substantially transparent plastic to permit viewing of an article secured therein.

19. The device defined in claim 18 wherein the housing includes a cylindrical sidewall formed with a plurality of cutouts and a generally disc-shaped bottom wall.

20. The device defined in claim 1 wherein the slide member includes a plurality of reinforcing ribs; and in which a pair of projections extend outwardly from certain of the ribs for engagement with the article when the lid is in the closed position.

21. The device defined in claim 1 wherein the outer shell and slide member are each one-piece plastic members free of moving parts.

* * * * *